United States Patent [19]

Henning

[11] 3,991,935

[45] Nov. 16, 1976

[54] OIL CLEANER

[75] Inventor: Erik Henning, Enskede, Sweden

[73] Assignee: Miljator AB, Stockholm, Sweden

[22] Filed: Feb. 4, 1975

[21] Appl. No.: 547,041

[30] Foreign Application Priority Data

Feb. 8, 1974 Sweden ..... 7401739

[52] U.S. Cl. ..... 233/23 R; 233/32; 233/47 R

[51] Int. Cl.[2] ..... B04B 9/00

[58] Field of Search ..... 233/15, 23 R, 27, 28, 233/32, 44, 47 R, 24

[56] References Cited

UNITED STATES PATENTS

| | | | |
|---|---|---|---|
| 520,131 | 5/1894 | Andersson | 233/27 X |
| 729,163 | 5/1903 | Hartmann | 233/28 |
| 978,238 | 12/1910 | Trent | 233/28 X |
| 1,101,548 | 6/1914 | Hoffman | 233/27 X |
| 2,667,338 | 1/1954 | Hemfort | 233/15 X |
| 2,755,992 | 7/1956 | Tait et al. | 233/23 R |
| 2,792,172 | 5/1957 | Tait | 233/2 |
| 3,762,633 | 10/1973 | Ishii | 233/23 R |

FOREIGN PATENTS OR APPLICATIONS

| | | | |
|---|---|---|---|
| 1,282,171 | 12/1961 | France | 233/DIG. 1 |

*Primary Examiner*—George H. Krizmanich
*Attorney, Agent, or Firm*—Ulle C. Linton

[57] ABSTRACT

A centrifugal type oil cleaner having a housing with rotor therein and passageways for feeding the oil into the bottom of the rotor and past narrow spaces for separating the oil and contaminations with the clean oil going out openings in the rotor rotating said rotor and them passing to a bottom outlet in said housing for reuse.

5 Claims, 1 Drawing Figure

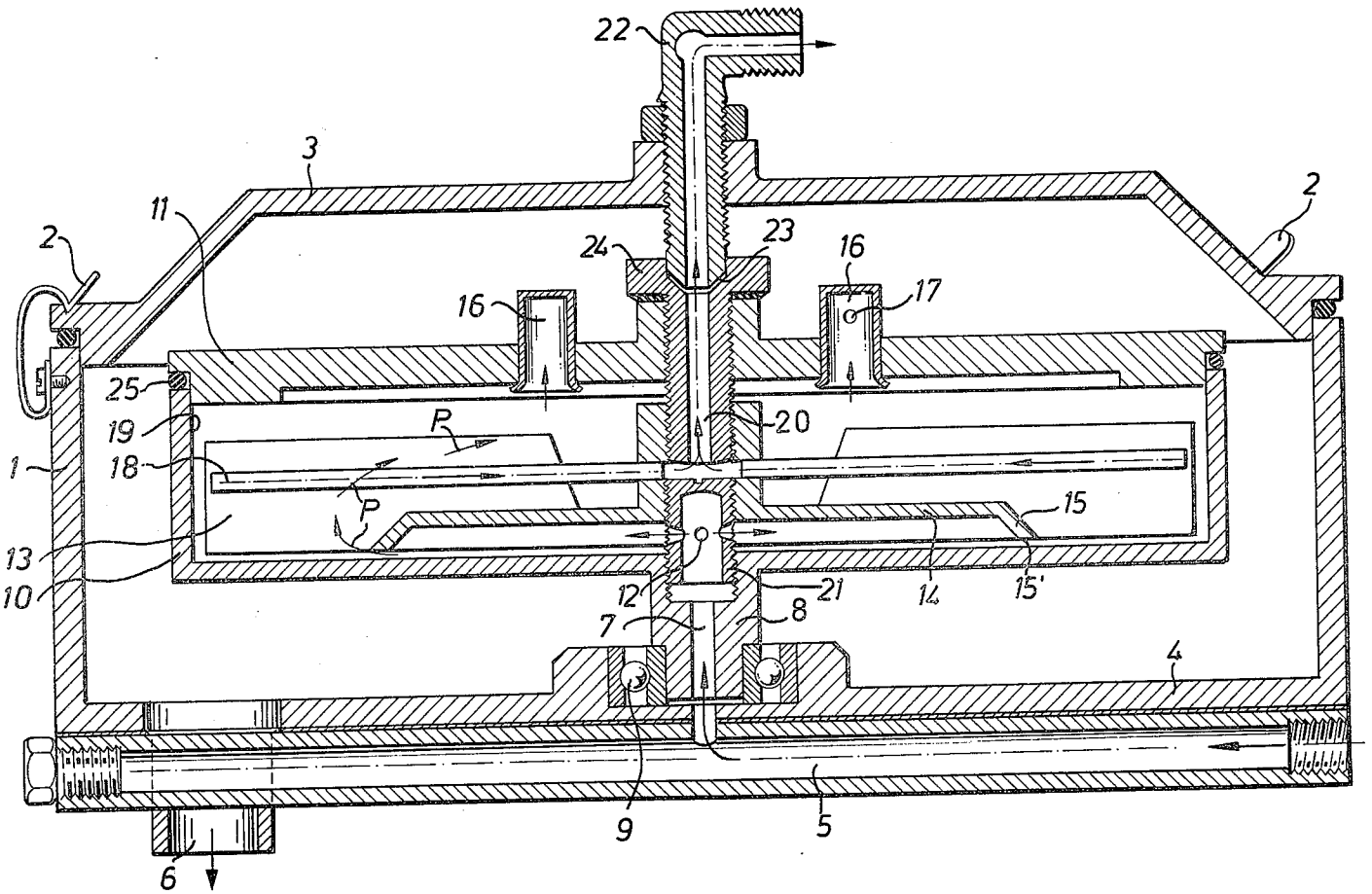
2
4
15
15'
14
17
16
21
8
5
23
20
22
24
12
7
9
16
P
P
3
11
25
19
18
6
2
1
13
10

OIL CLEANER

The present invention relates to an oil cleaner of centrifugal type, including a rotor whereby the rotor is mounted in a housing comprising supply and discharge channels for the oil.

A great number of oil cleaners of centrifugal type are previously known, and all of these have in common a drawback in that they only clean the oil to a lesser extent and thereby they usually only pick up the more heavy contaminants of the oil. Often, this incomplete cleaning is due to the fact that too low a speed is imparted to the oil by the rotation thereof, and thus, only the heaviest particles are thrown towards the periphery and thereby are separated from the oil. As a result thereof in the most cases the oil must be exchanged for relatively short intervals, which contributes to high costs as well as great environmental problems and a waste of the energy sources of the earth.

The object of the present invention is to eliminate the disadvantages mentioned above and other drawbacks in previously known oil cleaners of centrifugal type, which object is achieved by an oil cleaner which has the characteristics disclosed in the following claims, whereby an oil cleaner is obtained which at the same time saves interchange of, oil over substantially the whole life of for example, an internal combustion engine. In this context it may be noted that the oil cleaner according to the present invenion also is useful for example to separate water from oil, contaminations from oil for cooking purposes used in catering and in industrial food cooking due to the high efficiancy of the oil cleaner and the cleaner is also used to separate a number of other similar contaminations from oil and furthermore, the oil cleaner may be adapted to several different fields of uses wherein contaminations are to be separated from oils such as transformer oil or the like.

Further advantages and objects of the oil cleaner according to the present invention will be understood from the following description which, with reference to the accompanying drawing discloses an examplifying embodiment of the invention and the oil cleaner is in this case connected to some kind of internal combustion engine, preferably bigger than the usual car engine.

In the drawing the oil cleaner according to the invention is shown in section.

Reference numeral 1 designates a cylindrical housing provided with a releasable cap 2 by means of clamping means 3 or corresponding elements. The housing 1 includes a base plate 4 provided with at least one suitably shaped inlet channel 5 and an outlet channel 6. Hereby, the inlet channel 5 leads to a central inflow bore 7 in the axle 8 of a cylindrical rotor 10 rotatably journalled in the housing 1 by means of a ball bearing 9, which rotor also is provided with a releasable cap 11 to permit the cleaning of the rotor 10. The lower portion of the interior, closed space of the rotor 10 is provided with radial inlet-openings and a horizontal guiding disc 14 is mounted above these inlets and integrally provided with two wings or blades 13, and said guiding disc has a downwardly directed conical portion 15 at the outer radial part thereof to downwardly/outwardly guide the oil flowing therethrough. A narrow gap 15' is defined between the conical portion 15 of the guiding disc and the bottom of the rotor 10. Two or more outlet nozzles 16 are provided in the cap 11 of the rotor 10 and said nozzles have substantially tangential outlet openings 17 located perpendicular to the radius from the center of cap 11 to the center of each nozzle 16 in such a manner that the rotor is given a high rotational speed.

In the embodiment shown in the drawing a suction device is also provided for the contaminations received in the rotor, and preferably said suction device is to be used in oil cleaners utilized in ship engines, stationary engines or other bigger and/or stationary plants. The suction device substantially comprises four to six or optionally even more radially located suction tubes 18 extending to the vicinity of the inner jacket surface 19 of the peripheral wall of the rotor 10. The suction tubes 18 are, by means of a central channel 20 which by a screw plug 21 is separated from the central inflow 7, connected to a suction nipple 22, which may be coupled to a suitable suction source (not shown) such as a pump or the like. The nipple 22 is suitably attached to the cap 3 of the housing 1 and has a sealed rotatable bearing 23 at the upper portion of the nut 24 or similar element keeping the cap 11 of the rotor 10 sealingly engaging an O-ring 25, mounted between the rotor 10 and the cap 11 thereof.

The function of the device will now be further described, whereby the circulation of the oil through the oil cleaner will be observed. The oil to be cleaned is fed into the channel 5 from one end thereof and due to the pressure of the oil, obtained by means of a pump (not shown) or a similar means, further flows into the channel 7 and through the radial inlets 12 to the space defined between the guiding disc 14 and the interior bottom surface of the rotor 10. Due to the fact that the oil is distributed over a relatively large space and is pressed out through the gap 15', the speed thereof will be reduced and the oil will be led in the direction of the arrows P towards the outlet nozzles 16, i.e. the oil will flow against the action of the centrifugal force and inwardly towards the center of the rotor at the same time as it flows upwards. The wings 13 serve to assist and facilitate this flowing action. By the rotation of the rotor 10 the condition occurs that the contaminations in the form of more heavy particles are acted upon by the centrifugal force and deposited on the peripheral inner wall 19 of the rotor 10. Then, the oil flows outwardly substantially tangential through the outlet openings 17 in the outlet nozzles 16, which outwardly directed flow due to the generated reactional forces constantly maintains the rotational action of the rotor 10 which at an oil pressure of about 2,5 kp/cm$^2$ amounts to about 8000 – 10,000 rpm, but of course — according to the desired characteristics of the oil cleaner — the speed may be varied in several manner known per se. When the oil flows out from the outlet nozzles 16 the oil jets impinge onto the interior of the cap 3 and the oil runs downwardly towards the bottom of the housing 1 and outwardly through the outlet channel 6 for renewed using in the engine.

In the embodiment shown, the nipple 22 mentioned above, is also used and may be connected to a suction source and intermittently or continously suck the contaminations collected within the rotor 10 by means of the suction tubes 18. In smaller engines, such as ordinary car engines, the oil cleaner may be used without any suction device, however in this case, the rotor have to be manually cleaned at certain intervals. This cleaning is suitably accomplished by at first releasing the cap 3 and thereafter the nut 24 keeping the cap 11 of the rotor is loosed to permit the releasing of the cap 11, whereafter cleaning may easily be accomplished. In this latter embodiment the nut 24 lacks the central bore shown in the FIGURE or is this plugged.

Naturally, the invention is not limited to the embodiment described above and shown in the drawing, but may be varied in several ways within the scope of the following claims without departing from the spirit of the invention.

I claim:

1. A centrifugal oil cleaner comprising a housing having a bottom, side walls and cap detachably closing said side walls, means providing a passage in said housing bottom for oil to be cleaned, a hollow rotor having a bottom, sides, top and an axle rotatably mounted on said housing bottom, a guiding disc being located in said rotor and having a downwardly directed peripheral conical portion, said disc being spaced from said rotor bottom providing an oil space, said disc conical portion being spaced a narrow distance from said rotor bottom providing a relatively narrow gap for the outward passage of the oil, said rotor axle having a bore communicating with said oil passage and outlet openings communicating with said bore and said space between said disc and said rotor bottom, outlet nozzles being mounted in said rotor top having outlet openings communicating with the interior of said housing with the direction of said outlet openings being perpendicular to the radius from the center of said cap to the center of the respective nozzle and said housing bottom having an outlet opening.

2. A centrifugal oil cleaner as claimed in claim 1 including a plurality of said outlet nozzles mounted on the inner half of the radius of said rotor and said nozzles are each provided with outlet openings.

3. A centrifugal oil cleaner as claimed in claim 2 wherein said nozzles are mounted on opposite sides of the rotational axis of said rotor and said openings extend in a similar direction for guiding the oil in such a manner that it obtains a substantially tangential direction for rotating said rotor.

4. A centrifugal oil cleaner as claimed in claim 3 including a plurality of blades attached to and extending above said disc and extending radially of said rotor for assisting in the flow of the oil inwardly and upwardly to said nozzles.

5. A centrifugal oil cleaner as claimed in claim 1 including means providing a suction passageway axially of said rotor and through said housing and at least four tubes connected to said rotor and extending radially outwardly from the axis of said rotor towards and close to said rotor sidewall and each of said tubes communicating with said suction passageway for the removal of the oil contaminations collected in said rotor.

* * * * *